US005966836A

United States Patent [19]

Valdez, III et al.

[11] Patent Number: 5,966,836

[45] Date of Patent: Oct. 19, 1999

[54] INFRARED HEATING APPARATUS AND METHOD FOR A PRINTING PRESS

[75] Inventors: Benito Valdez, III, Farmers Branch; Paul D. Copenhaver, Colleyville; John A. Aylor, Ft. Worth; Howard C. Secor, Krum, all of Tex.

[73] Assignee: Howard W. DeMoore, Dallas, Tex.

[21] Appl. No.: 08/840,194

[22] Filed: Apr. 11, 1997

[51] Int. Cl.[6] ..... F26B 3/00

[52] U.S. Cl. ..... 34/448; 34/444; 34/267; 34/273; 101/424.1; 101/487

[58] Field of Search ..... 34/267, 273, 274, 34/418, 419, 420, 421; 101/424.1, 424.2, 487, 488

[56] References Cited

U.S. PATENT DOCUMENTS

| | | | |
|---|---|---|---|
| 3,900,959 | 8/1975 | Breschi et al. | 34/155 |
| 4,257,172 | 3/1981 | Townsend | 34/68 |
| 4,434,562 | 3/1984 | Bubley et al. | 34/4 |
| 4,449,453 | 5/1984 | Staffer et al. | 101/416 A |
| 4,501,072 | 2/1985 | Jacobi, Jr. et al. | 34/1 |
| 4,513,516 | 4/1985 | Bjornberg | 34/41 |
| 4,545,131 | 10/1985 | Ericsson | 34/4 |
| 4,594,266 | 6/1986 | Lemaire et al. | 427/55 |
| 4,596,935 | 6/1986 | Lumpp | 250/495.1 |
| 4,693,013 | 9/1987 | Pabst et al. | 34/4 |
| 4,698,767 | 10/1987 | Wensel et al. | 364/471 |
| 4,703,153 | 10/1987 | Pelonis | 219/370 |
| 4,716,658 | 1/1988 | Jacobi, Jr. | 34/4 |
| 4,727,655 | 3/1988 | Jacobi, Jr. | 34/4 |
| 4,773,167 | 9/1988 | Jacobi, Jr. | 34/4 |
| 4,783,908 | 11/1988 | Pabst | 34/4 |
| 4,798,007 | 1/1989 | Eichenlaub | 34/4 |
| 4,798,960 | 1/1989 | Keller et al. | 250/504 |
| 4,809,608 | 3/1989 | Wolnick et al. | 101/416.1 |
| 4,811,493 | 3/1989 | Burgio, Jr. | 34/4 |
| 4,813,153 | 3/1989 | Palmer et al. | 34/48 |
| 4,876,436 | 10/1989 | Ide et al. | 219/370 |
| 4,876,437 | 10/1989 | Kondo | 219/388 |
| 4,882,852 | 11/1989 | Kautto | 34/41 |
| 4,882,992 | 11/1989 | Schmoeger | 101/424.1 |
| 4,989,343 | 2/1991 | Ericsson | 34/4 |
| 5,010,659 | 4/1991 | Treleven | 34/41 |
| 5,060,572 | 10/1991 | Waizmann | 101/424.1 |
| 5,092,059 | 3/1992 | Wimberger et al. | 34/156 |
| 5,099,586 | 3/1992 | Anderson | 34/68 |
| 5,115,741 | 5/1992 | Rodi | 101/424.1 |
| 5,142,795 | 9/1992 | Abbott | 34/41 |
| 5,168,811 | 12/1992 | Cox et al. | 101/424.1 |
| 5,263,265 | 11/1993 | Melgaard | 34/17 |
| 5,296,680 | 3/1994 | Yamada | 219/388 |
| 5,317,127 | 5/1994 | Brewster et al. | 219/388 |
| 5,369,894 | 12/1994 | Schaffer et al. | 34/268 |
| 5,440,821 | 8/1995 | Hamrin | 34/267 |
| 5,443,005 | 8/1995 | Platsch | 101/424.2 |
| 5,502,788 | 3/1996 | Platsch | 392/424 |
| 5,537,925 | 7/1996 | Secor et al. | 101/424.1 |

FOREIGN PATENT DOCUMENTS

0089327A1 9/1983 European Pat. Off. .

OTHER PUBLICATIONS

Patent Abstract JP–A–59 136 261 (Komori Insatsu Kikai K.K.) Aug. 4, 1984.

*Primary Examiner*—Henry Bennett
*Assistant Examiner*—Pamela A. Wilson
*Attorney, Agent, or Firm*—Locke Liddell & Sapp, LLP

[57] ABSTRACT

A dryer (10, 200) is provided for use in drying freshly printed substrates such as corrugated sheets (14). A plurality of infrared heating lamps (28) are positioned below the travel path (16) of the corrugated sheets (14) and the heat lamps are physically separated from the corrugated sheets by glass panels (108, 110). Provisions are made for cooling the heat lamps by air flow. A plurality of air bars (40) are also provided with pressurized air to discharge air through ports (42) in the upper surfaces thereof for discharge against the corrugated sheet. Air discharged against the corrugated sheet and used to cool the heat lamps is collected and removed by a vacuum pump (48). This pump (48) is also used to remove moisture laden air which has been dislodged from the sheets by the combination of infrared heat and high pressure air.

25 Claims, 6 Drawing Sheets

INFRARED HEATING APPARATUS AND METHOD FOR A PRINTING PRESS

BACKGROUND OF THE INVENTION

In the printing industry, a number of manufacturers, such as United Container Machinery of Glen Arm, Md. and Hycorr Machinery Corp. of Kalamazoo, Mich. manufacture large printing presses of the type suitable for printing material on corrugated sheets of the type used to make boxes and displays. These presses can have a width of 110 inches or more to accommodate the size of corrugated box materials printed.

In the printing process, which may involve a number of printing stations to print different color inks, or apply different coatings, a problem exists in drying the just applied ink or coating sufficiently so that it is not marred or otherwise disturbed as the corrugated sheet moves from one printing station to the next and particularly before entering an in-line die cutter where the box is cut. Devices have been developed for drying the freshly printed substrates. However, drying has continued to be a problem, particularly as faster press speeds are desired.

SUMMARY OF THE INVENTION

In accordance with one aspect of the present invention, a dryer is provided for use in combination with a printing press of the type having a conveyor apparatus for transporting a freshly processed substrate along a travel path. The dryer includes a dryer assembly having a heat lamp assembly adapted for installation in a position adjacent the travel path of the substrate. The heat lamp assembly has a plurality of heat lamps facing the freshly processed substrates as they travel along the travel path, the heat lamps being below the travel path.

In accordance with another aspect of the present invention, a layer of glass is mounted on the heat lamp assembly between the heat lamps and the travel path. In accordance with another aspect of the present invention, a plurality of high pressure air bars are provided to discharge air against the freshly processed substrates traveling along the travel path. In accordance with another aspect of the present invention, a heat lamp assembly cooling mechanism is provided for cooling the heat lamp assembly.

In accordance with another aspect of the present invention, the heat lamp assembly includes a plurality of lamps directed at an angle relative to the travel path of the freshly processed substrate. In accordance with another aspect of the present invention, the freshly processed substrates are corrugated. In accordance with another aspect of the present invention, the layer of glass is formed of a plurality of glass sections which can be removed to more readily service the heat lamp assembly. In accordance with another aspect of the present invention, the high pressure air bars are mounted on the dryer assembly for ready removal to facilitate servicing of the heat lamp assembly. In accordance with another aspect of the present invention, the dryer assembly is mounted in a frame permitting the dryer assembly to be slid between an operating position and a servicing position to facilitate servicing. The dryer can include a quick release bar to lock the dryer assembly in the operating position.

BRIEF DESCRIPTION OF THE DRAWINGS

A more complete understanding of the invention and its advantages will be apparent from the following detailed description when taken in conjunction with the accompanying drawings, in which.

DETAILED DESCRIPTION

With reference now to the figures, there is described hereinafter a dryer 10 for use in a printing press particularly adapted to print ink and coatings on corrugated sheets 14 traveling along a travel path 16 within the press. Although the dryer 10 is described for use in printing presses specifically adapted for printing on corrugated box material, the dryer 10 can be readily adapted for use on other printing presses.

The dryer 10 is adapted to dry ink and coatings on the freshly processed substrate such as corrugated sheet 14 as it passes over the dryer along the travel path 16 by the use of infrared heating bulbs and air flow discharged from the dryer 10. The corrugated sheet 14 is conveyed along the travel path 16 by conventional mechanisms in the printing press and this mechanism will not be described. However, it will be noted that the printing press will convey the corrugated sheet 14 about 1 h to 2 inches above the dryer 10 at speeds of up to 700 feet per minute.

Figure 1:
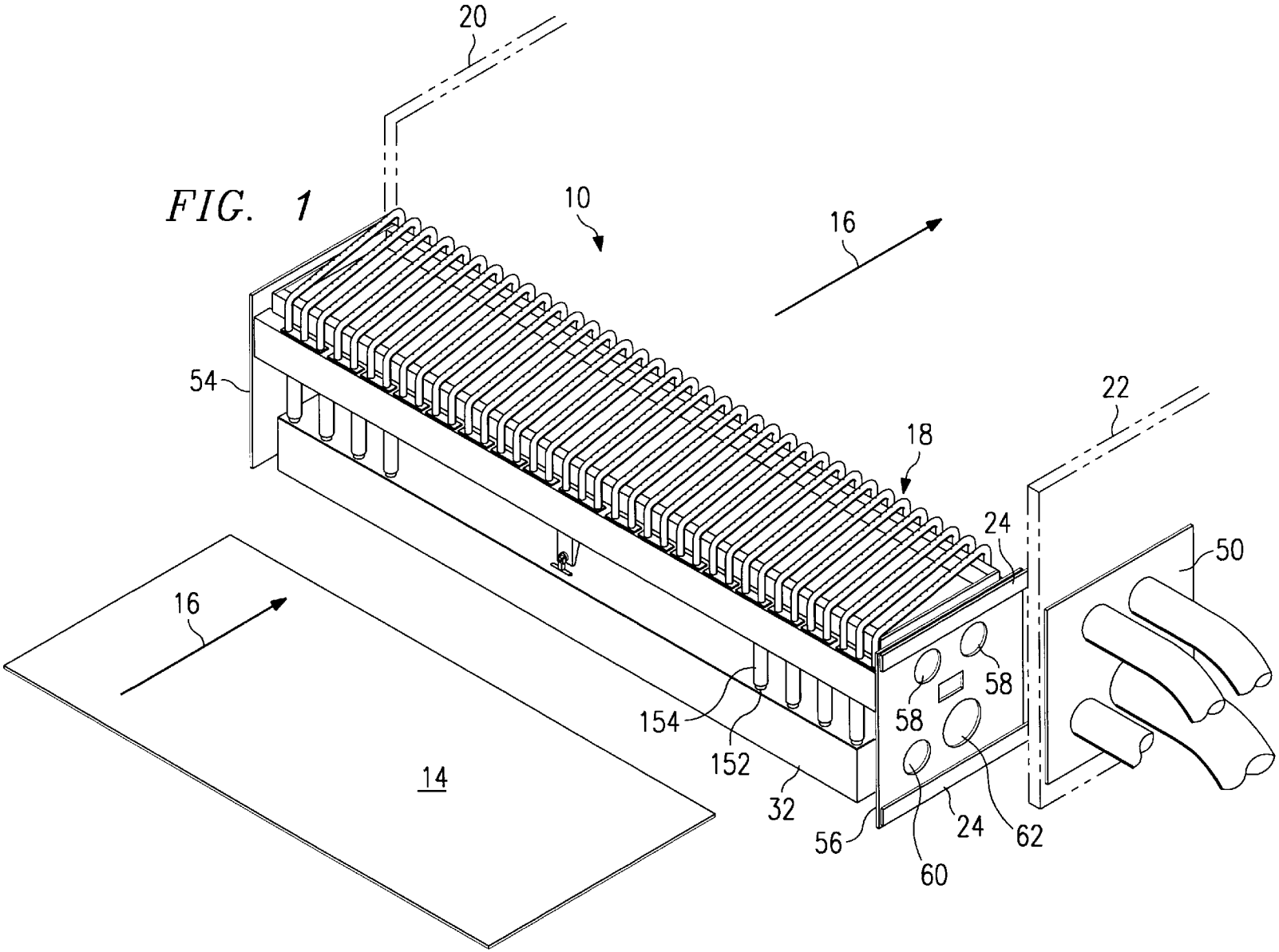
FIG. 1 is a perspective view of a dryer constructed in accordance with the teachings of the present invention.
Figure 3:
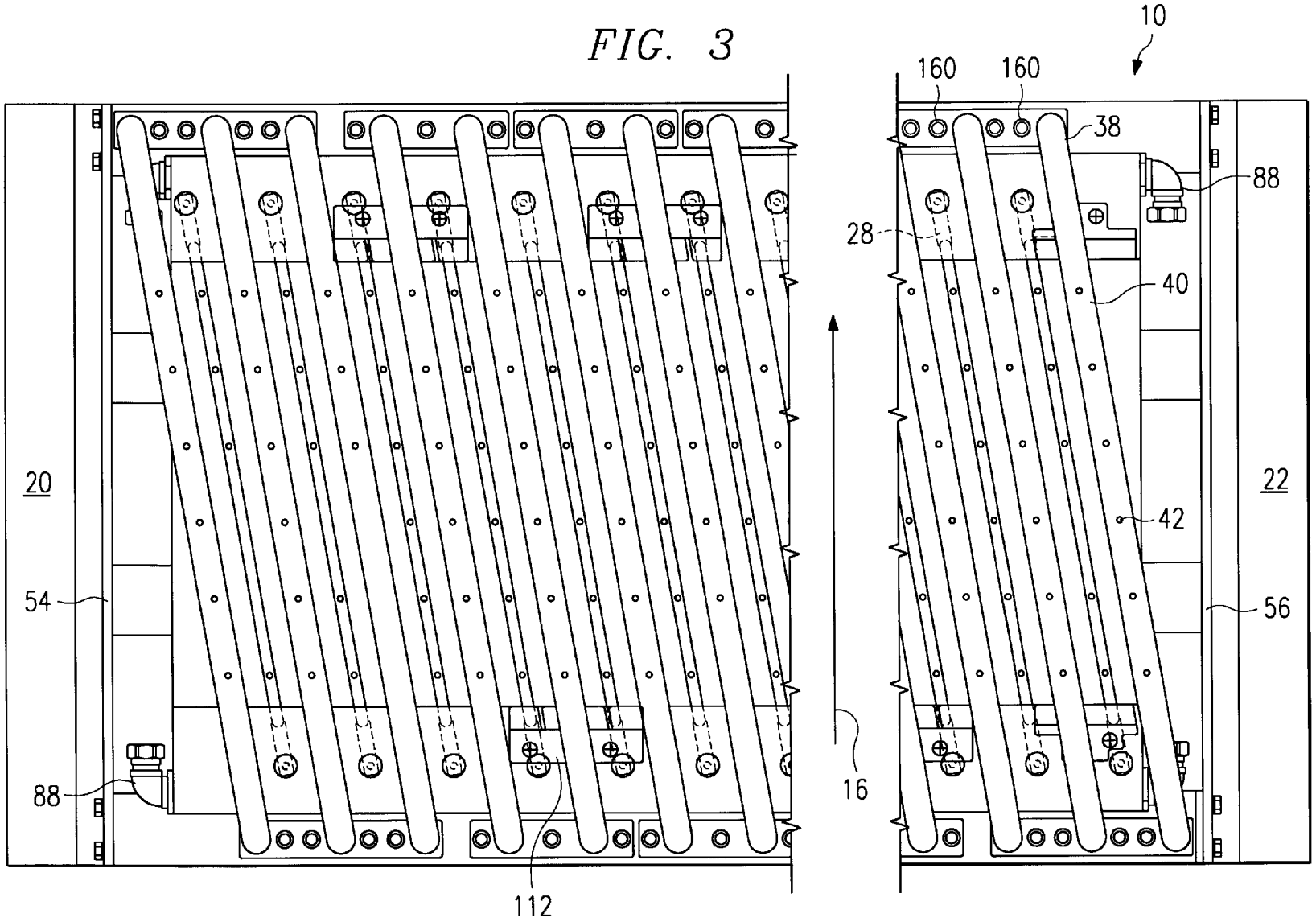
FIG. 3 is a partial plan view of the dryer.
Figure 4:
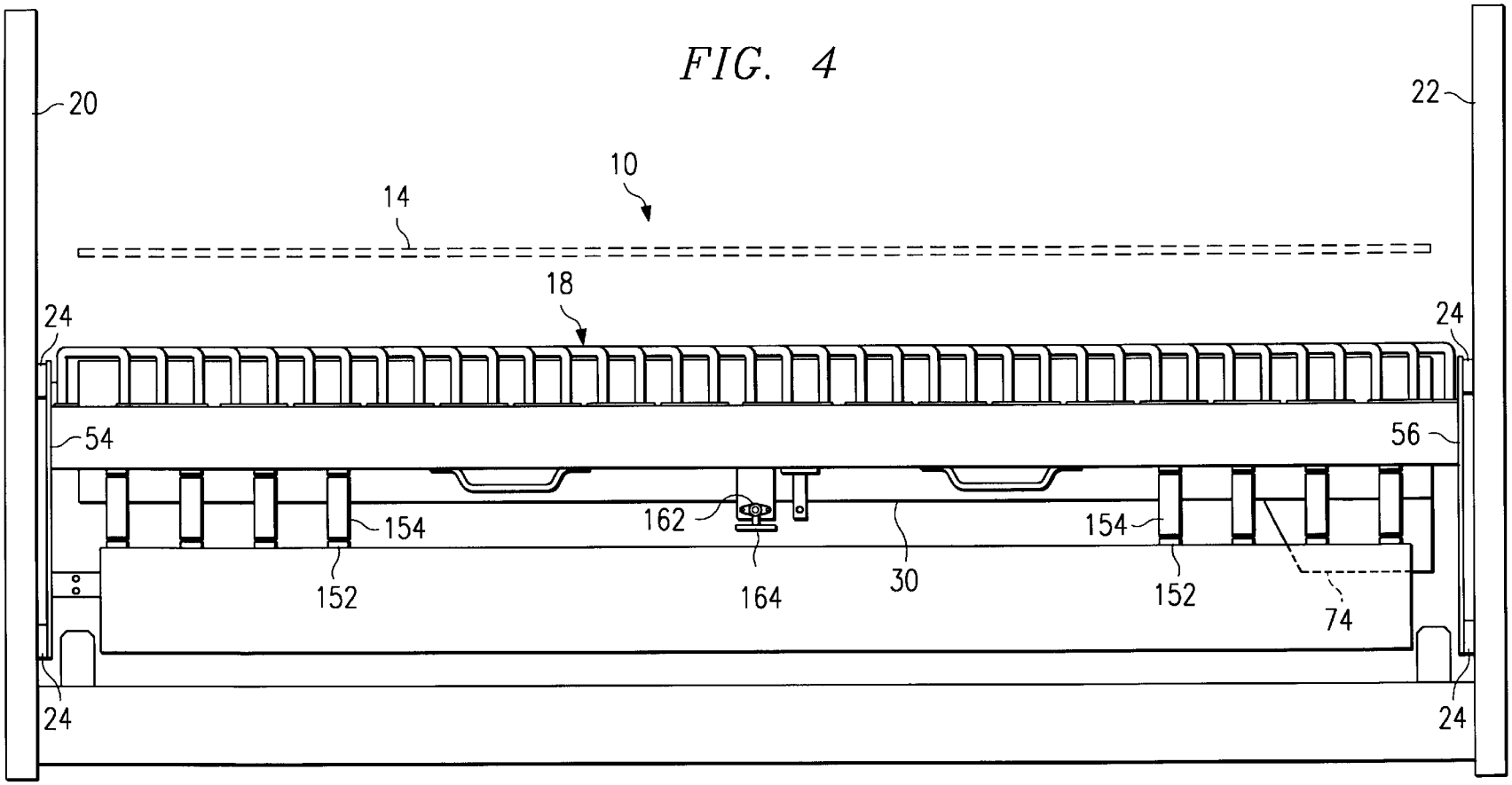
FIG. 4 is a front elevational view of the dryer.

The dryer 10 includes a dryer assembly 18 which is supported at its ends by a first frame 20 and a second frame 22 (FIG. 4). As will be described in greater detail hereinafter, the dryer assembly 18 is supported on the first and second frames 20 and 22 through slides 24 which permit the dryer assembly 18 to be moved in a direction parallel the travel path from the operation position as seen in FIGS. 3 and 4 to a servicing position as seen in FIG. 1 for easier servicing thereof.

Figure 2:
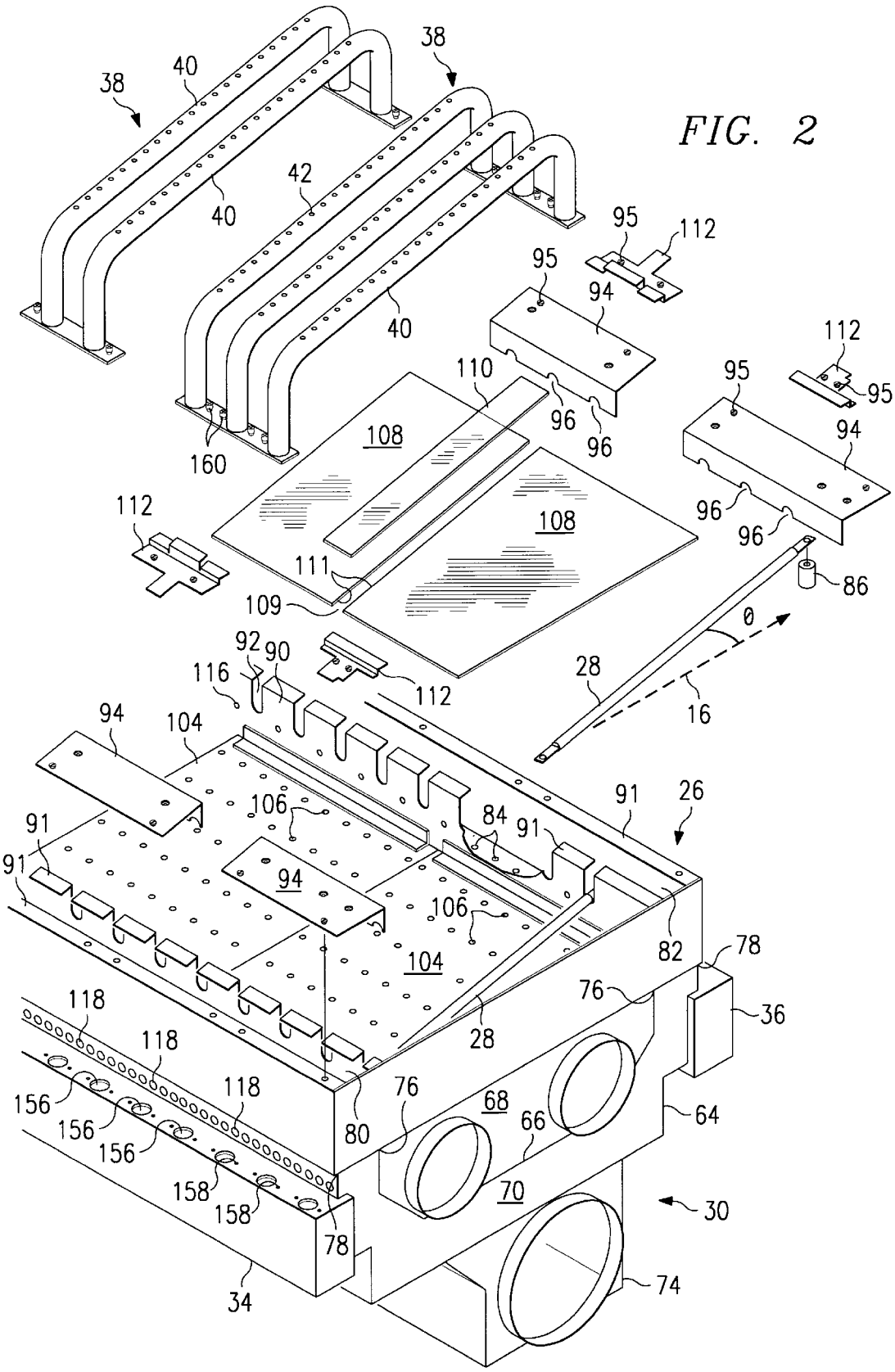
FIG. 2 is an exploded view of a portion of the dryer illustrating the components thereof.

The dryer assembly 18 includes a number of major subsections, including a lamp assembly housing 26 (FIG. 2) containing the individual infrared heating lamps 28, a combined vacuum and pressure chamber 30 for supplying cooling air to the heating lamps and removing the heated air after it has cooled the heating lamps, a collector chamber 32 (FIG. 1), first and second support manifolds 34 and 36 (FIG. 2) and a plurality of air bar rack assemblies 38 mounting individual air bars 40. Pressurized air is forced into the collector chamber 32 to force air into the support manifolds 34 and 36, and then into the individual air bars 40 for discharge of air through a series of individual holes 42 (FIG. 3) in the air bars 40 against the corrugated sheet 14 being dried. The vacuum portion of chamber 30 also removes the moisture laden air which has been dislodged from the sheet by the combination of infrared heat and high pressure air. Removal of this air is important to the speed of the drying process.

Figure 5:
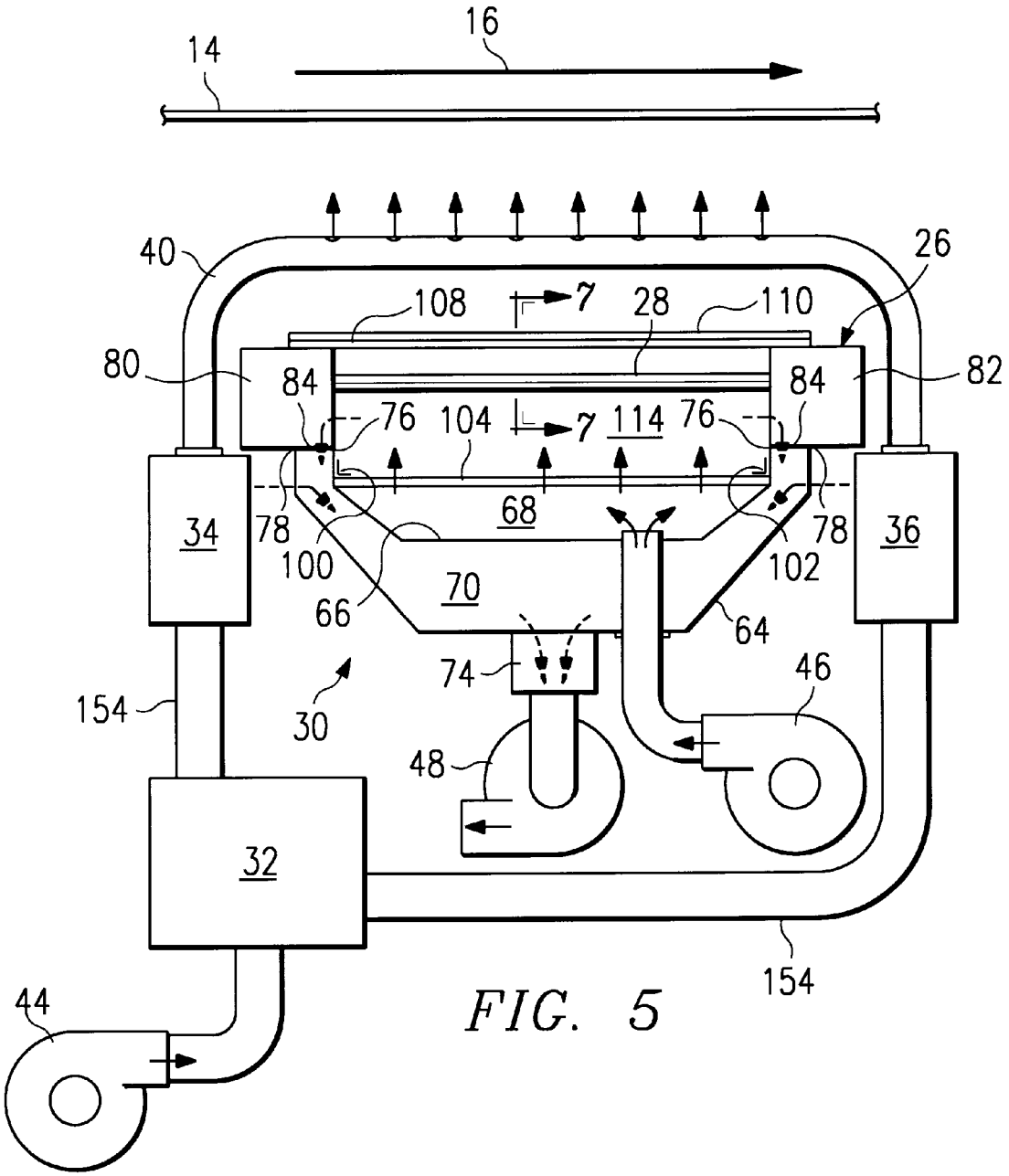
FIG. 5 is a schematic view of the air flow in the dryer.

In the dryer 10 illustrated in the figures, equipment for providing air flow through the dryer is placed outside the frames 20 and 22 (FIG. 5). The equipment includes an air pump 44 for supplying air under pressure to the air bars 40 for discharge against the corrugated sheet, a lamp cooling air pump 46 for providing pressurized air to the lamp assembly housing 26 for cooling the individual heating lamps 28 and a suction pump 48 for removing both the air discharged against the corrugated sheet 14 from air bars 40 and the air cooling the heating lamps 28 from the dryer. Suitable hoses run from these pumps to a retractable manifold plate 50 (FIG. 1) which is supported for movement on the second frame 22 by a hydraulic actuator. In a first position, the manifold plate 50 attaches the hoses to the various components of the dryer assembly 18 for supplying and withdrawing air. In a second position, retracted from the second frame 22, the dryer assembly 18 is free to move between the operation and servicing positions.

The dryer assembly 18 includes first and second end plates 54 and 56 (FIG. 4) which are attached through the slides 24 to the first and second frames 20 and 22, respectively. The combined vacuum and pressure chamber 30 is mounted between the end plates 54 and 56. Suitable pressure ducts 58 and 60 and vacuum duct 62 (FIG. 1) are formed through end plate 56 to connect the various air pumps with the chamber 30.

As can be seen in FIG. 5, the chamber 30 is formed of an outer channel 64 and an inner channel 66 which both extend the entire width of the dryer assembly 18 and define a pressure chamber 68 and a vacuum chamber 70. Pressurized air from the lamp cooling air pump 46 is provided through ducts 58 to the pressure chamber 68. The suction pump 48 is connected through vacuum duct 62 in end plate 56 to the vacuum chamber 70 through duct 74. The duct 74 is extended downward from outer channel 64 to provide spacing for the ducts, but can also mount a smoke detector therein.

The channels 64 and 66 define parallel edges 76 and 78 on each side of the chamber 30 to mount the lamp assembly housing 26. The lamp assembly housing 26 includes a first lamp housing base 80 on the upstream side of the dryer 10 and a second lamp housing base 82 on the downstream side of the dryer 10 (FIG. 5). The first lamp housing base 80 is mounted to the edges 76 and 78 of the channels 64 and 66 on the upstream side of the dryer while the second lamp housing base 82 is similarly mounted to the edges 76 and 78 on the downstream side of the dryer.

The bases are each provided with a plurality of holes 84 (FIG. 2) through the bottom surface thereof which open into the vacuum chamber 70 at the gap between edges 76 and 78. The diameter and spacing of the holes varies along the width of the bars from one side to the other for uniform air flow into vacuum chamber 70. Between the holes are mounted a series of vertical ceramic bases 86 for mounting the individual ends of the infrared heating lamps 28. Suitable electric conductors (not shown) are fed through the electrical connector elbows 88 (FIG. 3) at each end of the base 80 and base 82 to supply electrical power to the lamps for operation. Preferably, the wiring permits selected ones of the heat lamps 28 to be lit to adapt the dryer to corrugated sheets of widths less than the full width of the dryer or where only certain portions of a sheet need to be dried.

The ceramic bases 86 are staggered along base 80 to base 82 so that the infrared heating lamps 28 extend at an angle θ (FIG. 2) relative to the travel direction 16. Preferably, this angle θ is about 10°. Angling the heat lamps assures that every area on the corrugated sheets 14 will be exposed to direct and uniform radiation from the infrared heat lamps to ensure uniform drying.

Figure 7:
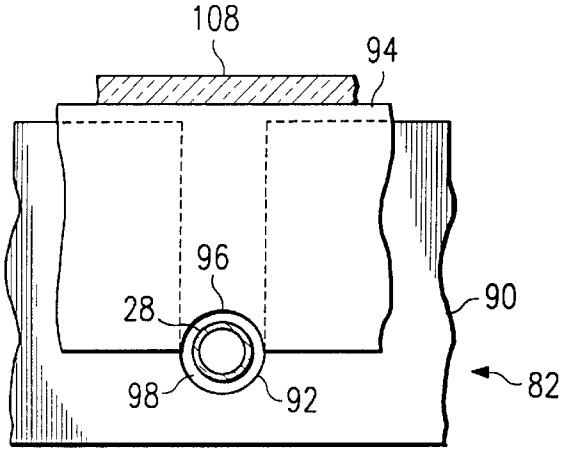
FIG. 7 is a cross-sectional view of a portion of the lamp assembly housing taken along line 7—7 of FIG. 5.

The inner wall 90 of each base 80 and 82 is provided with a series of cutouts 92 centered about the individual heat lamps. The top wall 91 extends only part of the way across the top of the bases 80 and 82 and has a continuation of cutouts 92 to facilitate installation and removal of the heat lamps 28. A series of end covers 94 are removably attached along the bases 80 and 82 to form the remainder of the top of the bases and a portion of the inner wall thereof. Each of the end covers has an L-shaped cross-section and has a series of cutouts 96 to be mounted concentric with the heat lamps 28. As can be understood, the cutouts 92 and 96 combine to define an annular opening 98 (FIG. 7) into the bases concentric with each of the heat lamps which will allow cooling air to pass therethrough as will be described hereinafter. Preferably, the end covers 94 are mounted to the bases 80 and 82 by easily actuated quick fasteners 95 to permit easy removal of the end covers 94 for servicing and replacing the heat lamps 28.

The inner channel 66 (FIG. 5) further defines facing ledges 100 and 102 which receive a series of reflector panels 104 therebetween to form a reflecting surface beneath the heat lamps 28. The reflector panels preferably have a series of apertures 106 therethrough to permit air in the pressure chamber 68 to be discharged about the heat lamps to cool the lamps. Preferably, the apertures 106 are spaced along lines extending at the angle θ to travel direction 16 as well.

A plurality of glass panels 108 (FIG. 2) are mounted between the bases 80 and 82 to cover the heat lamps therein. The glass panels 108 are separated by a slight gap 109 between their side edges which is covered by transition glass panels 110 supported on top of the panels 108. The glass panels 108 are sized and cut so that the side edges 111 extend at the angle θ relative to the travel path as well (except for the end panels, which have only one side edge angled). The size of the glass panels 108 is also designed so that the gaps 109 and glass panels 110 are between heat lamps 28, rather than being directly over them. The glass panels 108 and 110 are secured on the bases by a series of glass clamps 112. The glass clamps 112 are also preferably secured on the end covers 94 by readily actuated quick release fasteners 95. Certain of the glass clamps 112 have clamp portions clamping both glass panels 108 and 110 vertically, with the edge of the portion clamping glass panels 110 preventing horizontal motion of glass panels 108 as well.

It can be understood that the combination of the elements described define an enclosed chamber 114 (FIG. 5) containing the infrared heat lamps 28. Ambient air from exterior the press can be pumped by the lamp cooling air pump 46 into the pressure chamber 68. This air is discharged through the apertures 106 in the reflector panels 104 to flow over the individual heating lamps 28 and thereby cool the lamps. The heated air is then removed by a suction drawn in the vacuum chamber 70 by the suction pump 48 which draws air from the enclosed chamber 114 through the annular openings 98 (FIG. 7) and, if desired, other apertures 116 (FIG. 5) formed in the inner wall 90 of the bases 80 and 82. The air is then drawn down into the vacuum chamber 70 through the holes 84 in the bottom of the bases 80 and 82. The holes 84 are spaced and sized to achieve uniform air flow over all the lamps despite the mounting of the exhaust duct on only one side of the dryer assembly 18.

As can be readily understood, the use of the glass panels 108 and 110 permit a high percentage of the infrared radiation to pass therethrough to fall on the corrugated sheet 14 being dried, but prevents any debris, such as board particles, or the like, from falling on the infrared heating lamps 28 where they would likely be ignited. Thus, the infrared heating lamps 28 are physically separated from the corrugated sheet 14 being dried. Since a positive pressure is created in the chamber 114, this pressure also keeps the corrugated dust out of the chamber. However, by use of the structure described above, the heat lamps 28 can be accessed individually for repair or replacement without requiring major disassembly of the dryer 10.

With reference now to FIGS. 1 and 5, the collector chamber 32 can be seen to be connected to the air pump 44 through duct 60 formed through end plate 56. The collector chamber 32 extends the full width of the dryer assembly 18 and has a series of outlet nipples 152 which are connected to the first and second support manifolds 34 and 36 by air hoses 154. The location, number and size of the nipples and hoses are designed to provide sufficient uniform air flow into the support manifolds 34 and 36 for even air discharge against the corrugated sheet 14.

The support manifolds 34 and 36 extend the entire width of the dryer assembly 18 and define a plurality of spaced air holes 156 (FIG. 2) and a series of threaded apertures 158 through the tops thereof. The air bar rack assemblies 38 are bolted between the support manifolds 34 and 36 at threaded apertures 158. The hollow interior of each of the air bars 40 aligns with an opening 156 in the top of the support manifolds. Thus, air under pressure is supplied to the interior of the air bars 40 for discharge vertically upward against the corrugated sheet 14 through the holes 42 in the upper surface of the air bars.

As can be seen, each air bar rack assembly 38 includes either two or three air bars 40 thereon which, again, provides for easier servicing or replacement of a heat lamp 28 beneath the particular air bar rack assembly being removed. To even further the efficiency of servicing, the air bar rack assemblies 38 preferably mount individual threaded bolts 160 thereon to be received in threaded apertures 158 which are spring loaded and secured to the air bar rack assembly so that they cannot be lost or misplaced during servicing.

The air bars 40 are also mounted to extend in a direction at the angle θ from the travel path 16 of the corrugated sheets and are positioned directly between each of the heating lamps 28 vertically so that the maximum infrared radiation is incident on the sheet 14. It can be appreciated that, in addition to the cooling and drying feature of the air bars, the air bars further provide protection and isolation of the glass panels 110 and 108 and infrared heating lamps 28 from the rapidly moving corrugated sheet 14 traveling along the travel path 16.

The air discharged from the air bars 40, after impacting upon the corrugated sheet 14, is sucked into the vacuum chamber 70 through a plurality of individual apertures 118 (FIG. 2) in the sides of the outer channel 64. Whether the heating lamps 28 are on or off, the high pressure air from the air bars also helps to clean the corrugated material and also helps to keep the corrugated material from impacting onto the dryer.

In one dryer constructed in accordance with the teachings of the present invention, the dryer was designed to accommodate a travel path of about 112 inch width and a length along the path of about two feet. The infrared heating lamps are tubular quartz infrared bulbs with each bulb consuming 2 kilowatts of power manufactured and supplied by Philips. The glass panels 108 and 110 are formed of highly transparent glass ceramic material with virtually zero thermal expansion and a high percentage of transmission for infrared radiation such as panes manufactured and sold under the trademark ROBAX® by Schott Glaswerke, of Mainz, Germany. The reflector panels 104 are formed of a highly reflective alloy with superior photometric and surface qualities having a high percentage of total reflectance such as manufactured and sold under the trademark SPECULAR 2000® by Metalloxyd, Inc. of Atlanta, Ga. which is an alloy 1085 with purity of 99.85%. This material has a total reflectance of 87% to 88% and an image clarity of 95% minimum. The air pump 44 is driven by a 20 horsepower electric motor, the lamp cooling air pump is driven by a 3 horsepower electric motor and the suction pump 48 is driven by a 5 horsepower electric motor. Thirty-six heating lamps are used, spaced about 3 inches apart, and thirty-seven air bars 40 are used. Thirty-four holes are provided in each air bar through its upper surface.

The dryer assembly 18 further mounts a locking bar 162 (FIG. 4) which locks the dryer assembly 18 into the operational position relative the first and second frames 20 and 22. By rotating handle 164, the locking bar is disengaged, permitting the dryer assembly 18 to slide upstream along the travel path 16 along slides 24 for facilitated servicing of the unit.

A further modification can be made to air bars 40 by adding holes on the bottom side of the bars to discharge air against the glass panels, to keep them clean.

Figure 6:
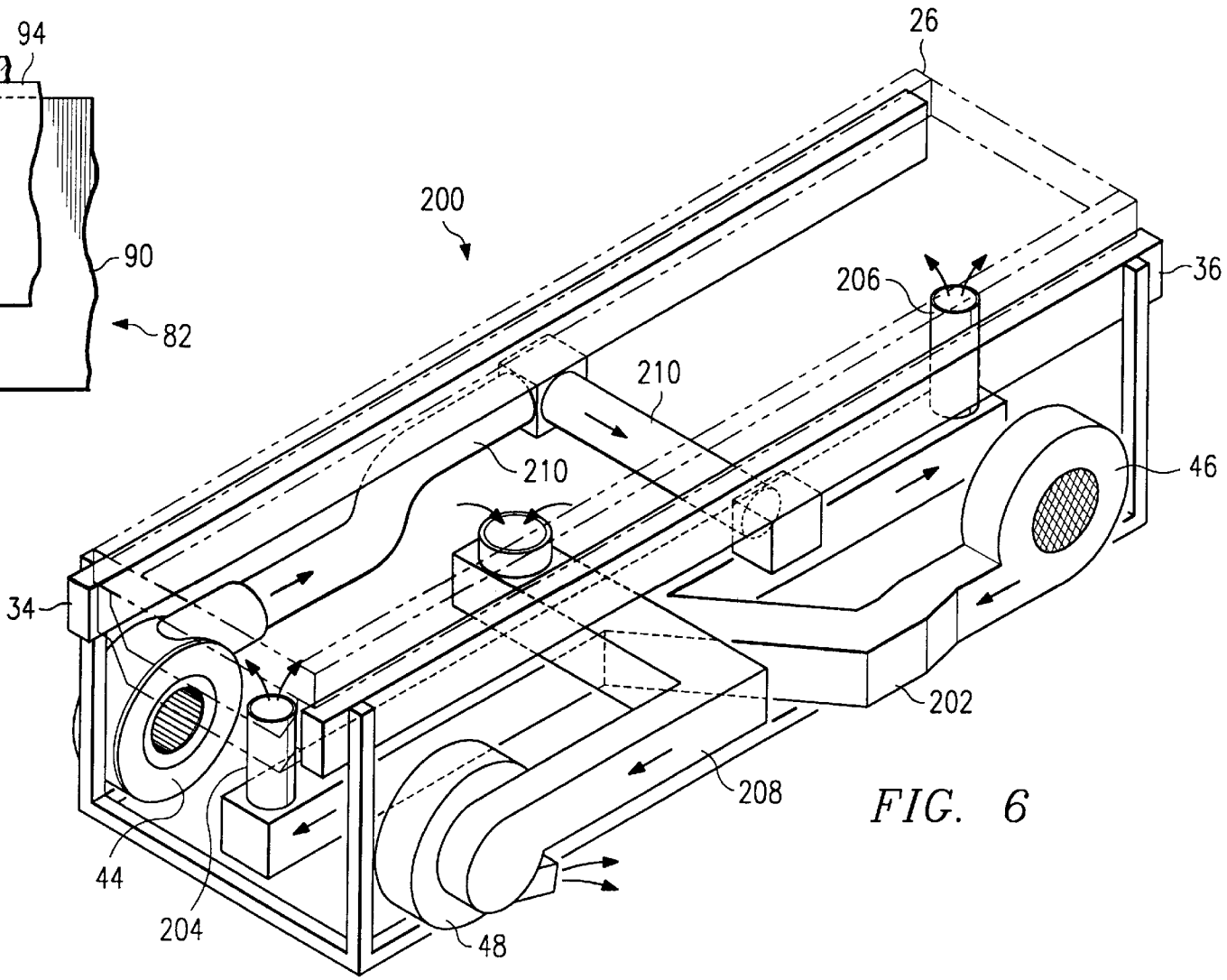
FIG. 6 is a perspective view of a dryer forming a first modification of the present invention.

As seen in FIG. 6, a modified dryer 200 is illustrated. The dryer 200 contains the same lamp housing assembly 26, air bars 40 and support manifolds 34 and 36 as dryer 10. (The air bars 40 and most of lamp housing assembly 26 are not shown in FIG. 6 to better illustrate the modification of dryer 200.) However, dryer 200 is designed to have the pump motors, and fans and ducting therefor, beneath the lamp assembly housing 26 and within the confines of the frames 20 and 22. Lamp cooling air pump 46 discharges air under pressure into a duct 202 which extends the width of the dryer 200 and is connected to the pressure chamber 68 through two vertical hoses 204 and 206. The suction pump 48 is connected through a duct 208 to the center of the vacuum chamber 70. This allows the spacing and size of holes 84 to be more uniform while still achieving uniform air flow over the heat lamps. The air pump 44 is connected to the support manifolds 34 and 36 by ducts 210. In one device constructed in accordance with the teachings of this invention, the air pump 44 was a 20 horsepower electric motor while the pumps 46 and 48 were driven by 3 horsepower electric motors.

Although the present invention and its advantages have been described in detail herein, it should be understood that various changes, substitutions and modifications of parts and elements can be made without departing from the spirit and scope of the invention as defined by the appended claims.

We claim:

1. A dryer for a freshly printed surface on a sheet moving in a machine direction in a printing press along a travel path having the width of a printed sheet and operating spaces above and below it, comprising:

a dryer assembly adapted for mounting in cross machine direction across the width of the travel path in one of the operating spaces in order to dry the freshly printed surface of a sheet moving along the travel path;

the dryer assembly including in combination:

an elongated housing having a lamp housing, a high velocity air manifold and a suction chamber;

a plurality of lamps in the lamp housing mounted to direct infrared radiation toward the path;

a multiplicity of air distribution openings flow connected to the high velocity air manifold for distributing air under pressure through said openings toward the path;

a plurality of air flow apertures in fluid communication with the suction chamber wherein said air flow apertures run in the cross machine direction along the side of the housing to withdraw spent air from said one operating space where the dryer assembly is;

whereby infrared radiation and high velocity air are directed toward, and spent air and volatile material extracted from the same one operating space by the dryer assembly without spatially interfering with the other of the operating spaces.

2. The dryer of claim 1 wherein a plurality of air bars contain the multiplicity of air distribution openings, said air bars being connected to the high velocity air manifold and mounted to protect the lamps.

3. The dryer of claim 2 wherein the lamp housing comprises a layer of glass between the plurality of lamps and the travel path to protect the lamps.

4. The dryer of claim 3 wherein the lamp housing is in joint air flow communication with a pressure chamber and the suction chamber in a manner that creates a positive pressure of cooling air which prevents lint and cardboard dust from reaching the lamps.

5. The dryer of claim 4, further comprising an end frame and a slide mechanism interconnecting said end frame and said housing, said housing being slidable relative to said end frame between an operation position and a servicing position.

6. The dryer of claim 5 wherein air under pressure and suction is applied to the housing by means of a retractable manifold plate and an end plate connected to the housing.

7. The dryer of claim 1 wherein the elongated housing has a first upstream side and a second downstream side with respect to the travel path, said plurality of air flow apertures in fluid communication with the suction chamber being located along the first and second sides of the housing running across the width of the travel path whereby spent moisture laden air is extracted from said one operating space.

8. The dryer of claim 7 wherein the lamp housing is enclosed by a plurality of removable glass panels facing the travel path and provided with a plurality of cooling air openings in flow communication with a pressure chamber and suction air openings in flow communication with the suction chamber, configured to maintain a positive air pressure within the lamp housing to prevent the entrance of dust, lint, dirt and volatiles.

9. The dryer of claim 8, further comprising an end frame and a slide mechanism interconnecting said end frame and said housing, said housing being slidable relative to said end frame between an operation position and a servicing position.

10. The dryer of claim 8 wherein a plurality of air bars contain the multiplicity of air distribution openings, said air bars being connected to the high velocity air manifold and mounted to protect the lamps.

11. The dryer of claim 8 wherein the plurality of lamps are wired for selective operation to adapt the dryer for sheets which vary in width or drying needs.

12. The dryer of claim 9 wherein air under pressure and suction is applied to the housing by means of a retractable manifold plate and an end plate connected to the housing.

13. The dryer of claim 7 wherein a plurality of air bars contain the multiplicity of air distribution openings, said air bars being connected to the high velocity air manifold and mounted to protect the lamps.

14. The dryer of claim 7 wherein the high velocity air manifold includes a first manifold extending along the upstream side of the housing and a second manifold extending along the downstream side of the housing and where the air bars have a flow connection with both of the first and second manifolds to improve air distribution, the air bars being mounted to protect the lamp housing.

15. The dryer of claim 14 wherein the air bars are a plurality of air bar rack assemblies, each assembly having at least two air bars thereon wherein said assemblies are mounted on the housing with the air bars extending over the lamp housing.

16. The dryer of claim 15 wherein the air bar rack assemblies are mounted on the housing for quick removal in order to access the lamp housing for maintenance.

17. A method of drying the freshly printed surface of a sheet in a manner that utilizes the space adjacent to the freshly printed surface without intruding into space adjacent the opposite surface of the sheet;

moving a sheet having a freshly printed surface in a machine direction along a path;

providing drying equipment in the space next to the freshly printed surface, positioned in cross machine direction in a width exceeding the width of the freshly printed surface of the sheet, the drying equipment comprising a suction chamber, a lamp chamber, a support manifold, a multiplicity of manifold distribution openings and a plurality of infrared radiating lamps directing radiation from the lamp chamber onto said freshly printed surface;

providing air under pressure to the support manifold and thereby distributing high velocity air from the manifold distribution openings to the printed surface;

operating said lamps and irradiating the printed surface of the sheet;

drawing spent air from the manifold distribution openings and lamp chamber into the suction chamber through openings spaced apart along the cross machine direction of the drying equipment; and whereby the drying equipment is positioned to dry and extract spent air and volatiles from a location opposite one surface of the sheet leaving the area adjacent the opposite surface of the sheet free from spatial interference by the said drying equipment.

18. The method of claim 17 further including the step of cooling the infrared radiating lamps by means of a flow of air.

19. The method of claim 18 wherein the step of irradiating the printed surface of the sheet is performed by positioning a layer of glass over the lamps and passing the radiation through the glass.

20. The method of claim 19 wherein the step of operating said lamps is performed by enclosing the lamp chamber with said layer of glass and maintaining a positive pressure in the lamps chamber with the flow of cooling air.

21. The method of claim 17 further including mounting a plurality of air bars in flow communication with the support manifold and distributing high velocity air from manifold distribution openings in said flow bars.

22. The method of claim 21 whereby the drying equipment has a first upstream side and a second downstream side by reference to machine direction wherein the step characterized as drawing spent air draws spent air simultaneously from along the upstream and downstream sides of the drying equipment.

23. The method of claim 17 further including the steps of disconnecting sources of air under pressure and suction by disconnecting a manifold plate and sliding said drying equipment from an operation position to a servicing position.

24. The method of claim 23 wherein the step of sliding the drying equipment is performed by sliding in the machine direction.

25. The method of claim 17 further including the step of selectively operating the lamps for drying sheets which vary in width or drying needs.

* * * * *